United States Patent [19]

McGettigan et al.

[11] Patent Number: 4,604,862

[45] Date of Patent: Aug. 12, 1986

[54] MANUFACTURE OF TELECOMMUNICATIONS CABLE CORES

[75] Inventors: Philip A. McGettigan, Montreal; Jean M. Roberge, Pointe Claire, both of Canada

[73] Assignee: Northern Telecom Limited, Montreal, Canada

[21] Appl. No.: 565,633

[22] Filed: Dec. 27, 1983

[51] Int. Cl.[4] ..... D01H 7/46; D01H 1/10; D01H 7/86

[52] U.S. Cl. ..... 57/264; 57/58.55; 57/63; 57/94; 57/100; 57/314

[58] Field of Search ..... 57/6, 9, 218, 206, 207, 57/212, 214, 264, 58.3, 58.32, 58.34, 58.36, 58.38, 58.55, 58.63, 293, 92, 93, 94, 96, 314, 68; 174/34

[56] References Cited

U.S. PATENT DOCUMENTS

| | | | |
|---|---|---|---|
| 2,869,316 | 1/1959 | Lilly | 57/93 |
| 3,140,577 | 7/1964 | Ash | 57/293 X |
| 3,715,877 | 2/1973 | Akachi | 57/58.36 |
| 3,882,907 | 5/1975 | Degen | 57/93 X |
| 4,102,117 | 7/1978 | Dornberger | 57/93 |
| 4,408,443 | 10/1983 | Brown et al. | 174/34 X |

FOREIGN PATENT DOCUMENTS

| | | | |
|---|---|---|---|
| 691105 | 10/1930 | France | 174/34 |
| 1303106 | 1/1973 | United Kingdom | 57/59 |

*Primary Examiner*—Stuart S. Levy
*Assistant Examiner*—Joseph J. Hail, III
*Attorney, Agent, or Firm*—R. J. Austin

[57] ABSTRACT

A core unit and method and apparatus for making it in which conductor pairs or units having a single direction of twist and in which angles of twist lay change along lengths of the conductor pairs. In a preferred and practical construction, the angles of twist lay of all pairs change along their lengths on a continuous basis. This angle change is cyclical and with the cycles of the angles of the pairs being out-of-phase with one another. This achieves average twist lays of the units which are substantially equal to one another from conductor pair-to-pair. The structure is achieved in a tandem operation of twisting conductors into pairs and then forming them into the core unit, preferably by stranding.

8 Claims, 8 Drawing Figures

FIG. 1
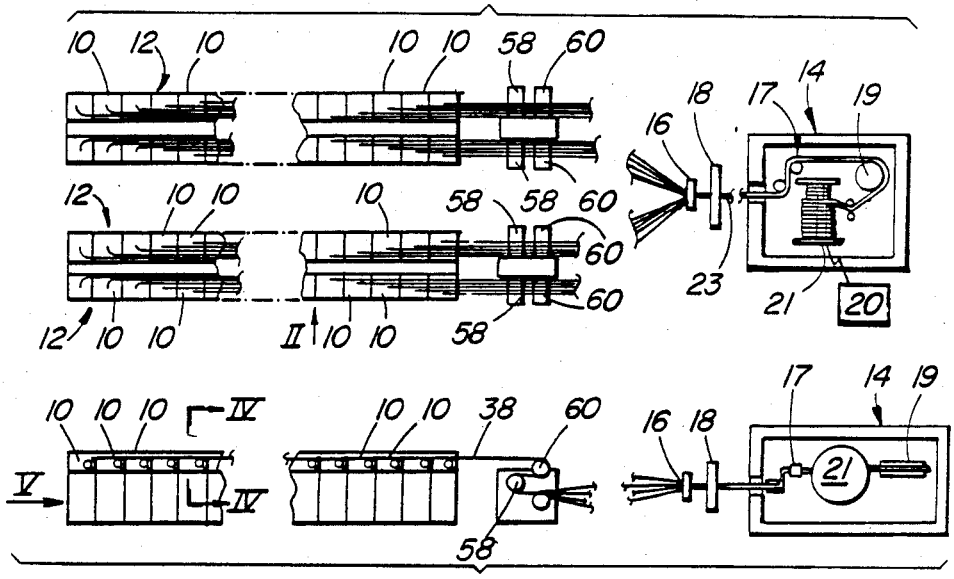
FIG. 2
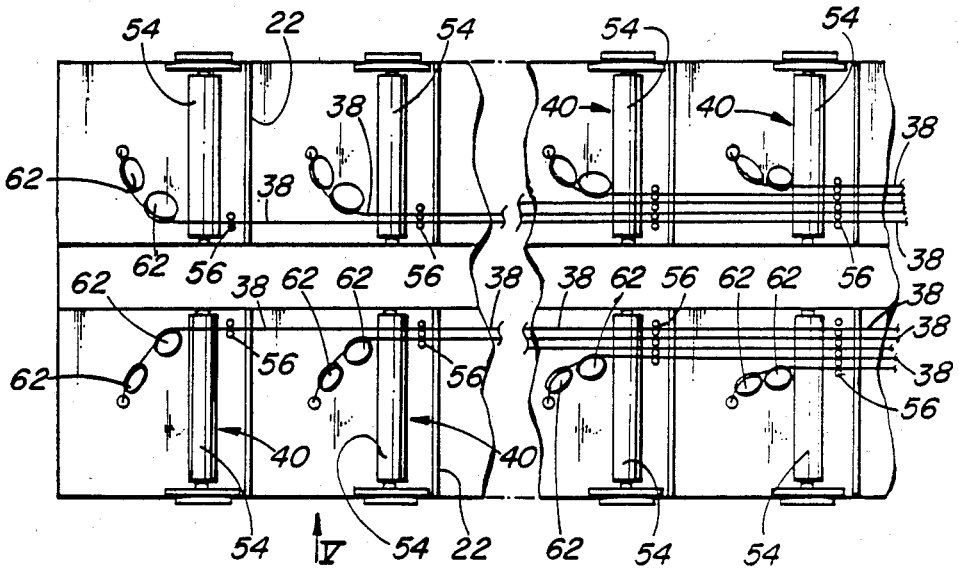
FIG. 3

MANUFACTURE OF TELECOMMUNICATIONS CABLE CORES

This invention relates to the manufacture of telecommunications cable cores.

A telecommunications cable is constructed with a core having a multiplicity of twisted units of conductors, each unit conventionally being a twisted pair of conductors. A core may be typically formed as a single core unit of twisted pairs, e.g. 50 or 100 pairs, or larger cores, e.g. up to 4,200 twisted pairs, each comprises a plurality of core units. The twisted pairs are assembled together, e.g. by stranding, to form a core unit with the conductors of each pair twisted together with a predetermined lead to the twist, i.e. the distance taken along the pair for each conductor to complete a single revolution along its path. This distance will be referred to in this specification as the "twist lay" of a pair. The angle which each conductor makes with the longitudinal axis of its conductor unit as it extends along its twisted path will be referred to as the "angle of twist lay". There are different twist lays provided for the twisted pairs in a core unit with each pair having a particular lay and being adjacent to other pairs of different lays. Care is taken, so far as is practicable, to ensure that pairs of equal or substantially equal twist lays are separated from each other. The reason for this arrangement is to attempt to maximize the communications performance of the cable, i.e. to lessen pair-to-pair capacitance unbalance and to reduce crosstalk between pairs.

However, the use of different twist lays for the different pairs presents its own problems as the mutual capacitance between conductors in a pair is influenced by the twist lay. In a pair with a short twist lay, the mutual capacitance between conductors tends to be higher than in a pair with a longer twist lay. It is believed that this variation in mutual capacitance is caused by the degree of compression of insulation between the conductors which brings conductors of a pair closer together for shorter twist lays. While conductors having plastic insulation show some mutual capacitance variation for different twist lays, a larger variation is found with conductors having pulp insulation which is more compressible under a given load than plastic.

It is particularly important to strive towards providing a telecommunications cable with minimized differences between mutual capacitances between conductors in the different conductor pairs, and both empirical data and theoretical considerations have shown that such a movement towards equalizing mutual capacitances would provide smaller variations in other electrical characteristics of the cable, e.g. inductance between conductors and pairs, impedance and attenuation. Deviations of these electrical characteristics from the desired or nominal values would be less.

Conventionally, the conductors of each pair are twisted together in a completely separate operation from forming of twisted pairs into a core unit. The conductors of each pair are twisted together in a high speed twisting machine in which the two conductors are held upon reels which are freely rotatable in a reel cradle. The two conductors are fed from their reels, are brought together into a common path and are twisted into the pair by rotating a flyer. The twisted pair is then wound onto another reel immediately after twisting. This reel is removed from the twisting machine and stored until required for forming into a core unit. At this stage, it is placed in supply stands for a core unit forming means with other reels of twisted pairs and the core unit is built. A problem with this process is that a large inventory and storage for reels of twisted pairs of different conductor gauges, insulation colours and of twist lay are required for making core units which may be of different gauge, colour or arrangement of twist lays in the pairs from one unit to the next. As an example of the inventory and storage for twisted pairs for one cable design, a cable core of 3,600 twisted pairs of pulp insulated conductor may require up to twenty-five different lengths of twist pitch for the manufacture of its core units.

The present invention provides a method and apparatus for the manufacture of a core unit in which the inventory and storage for reels of twisted pairs is avoided. In the present invention, a plurality of twisting machines are placed in tandem with a core unit forming and take-up means, and the flyers of at least some twisting machines are driven at different rotational speeds from others and with the rotational speed of at least one flyer changeable independently of the speeds of other flyers.

According to one aspect of the present invention, an apparatus is provided for making a core unit for telecommunications cable from twisted units of individually insulated conductors comprising a plurality of twisting machines each for carrying a plurality of reels of insulated conductor and each comprising a flyer bar which is rotatable to introduce twist into the conductors to cause them to twist to form a twisted unit; means for rotating each of the flyers and for changing the ratio of the rotational speeds of at least two of the flyers, a core unit forming and take-up means in tandem with the twisting machines to draw the twisted units together and form a core unit, said core unit forming and take-up means comprising drawing means to draw twisted units into the forming and take-up means.

On a practical basis, means is provided to change the ratio of rotational speeds of more than two and preferably all of the flyers.

The flyers may be arranged with their rotational speeds in groups. The speed ratios of groups may be changed. Preferably, however, each flyer is independently drivable to enable it to have its rotational speed changed without affecting the speeds of any other flyer, whereby its speed ratio relative to any other flyer is changeable. This may be made possible by providing a suitable individual and changeable speed drive to each flyer such as a mechanical drive having manually or automatically selectable gear ratios. In a practical sense, it is advantageous to provide each of the twisting machines with its own individual variable speed drive motor, and this conveniently is an AC electric motor.

The angle and length of twist lay of any twisted pair is, of course, influenced by the relationship of the speed of rotation of its flyer and the feed speed of the conductors through the twisting machine, the latter governed by the line speed of the core unit being formed.

With the use of the invention, the ratio of speeds of rotation of the flyers may be changed after manufacture of a core unit thereby changing the relationship between the twist lays of the pairs, thus resulting in the succeeding core unit being of different design. It follows that the present invention provides apparatus which produces a plurality of twisted pairs and then forms a core unit in tandem with the twisting operation, thereby avoiding the use of two distinct and separate process steps for these operations and the consequent need for an inventory and storage of reels of twisted conductor pairs of different twist lay and colours. In addition, in providing for changing ratios of speeds of the flyers, the apparatus has a universal application for core unit manufacture in that it is capable of producing many distinct and different twist lays from each twisting machine to provide the capability for a change in design of core unit.

To control closely the twist lay of each twisted pair, means is provided to measure the line speed of the core unit being made and a signal sent from the measuring means influences the rotating means for the flyers to vary flyer rotation according to any variation in core unit line speed.

According to a further aspect of the present invention, apparatus is provided for making a core unit as defined above and in which means is provided to change the ratios of speeds of flyers during operation of the means to drive the core unit forming and take-up means. The flyer speed is preferably changeable on a continously changing or cycling basis between upper and lower limits for angles of twist lays, e.g. angles which correspond to twist lays between 2.7 inches and 5.1 inches. While it is possible to provide a complete cycle of change in angle of twist lay between upper and lower limits over different lengths of the core unit for different twisted pairs, this would provide crossover points of the cycles thus producing equal angles of twist lays for different pairs at specific locations along the core unit. As the occurrence of such a phenomenon should be minimized as much as possible, it is preferable that all of the cycles are of the same length and are out of phase with one another.

The invention also includes a method of making a core unit of twisted insulated conductor units comprising:

twisting insulated conductors together in twisting stations into a plurality of twisted insulated conductor units to provide angles of twist lay which differ between conductor units at any cross-section through the core unit with each conductor unit having a single direction of twist along its length, and controlling the angle of twist lay of each of the conductor units while changing the angles of twist lay of some at least of the twisted conductor units during their formation; and moving the twisted conductor units downstream from the twisting stations and into a core unit forming and take-up means to draw the twisted units together to form the core unit.

The method of the invention preferably includes controlling the angle of twist lay of each of the conductor units so that, at any position along the core unit, the angle of lay either differs from that of another conductor unit or is changing in a different sense from that of another conductor unit which has the same angle of twist lay. It is also preferable to change the angle of twist lay of at least some units continuously.

In a particular method, the angles of twist lay of all of the conductor units are changed continuously in cycles which have substantially equal lengths, amplitudes and cycle shapes. With this particular method, the average twist lay of each unit is substantially equal to that of each other unit, thereby reducing to substantially zero, the variation in mutual capacitance due to each conductor unit having different twist lays.

While the angles of twist lays of all the conductor units may be changed continuously, it is possible to leave the lay angle of one or more of the twisted conductor units unchanged in a case where the twist lays of these certain units are outside the limits of the changing lays.

In addition, the invention includes a core unit for a telecommunications cable comprising a plurality of insulated conductors formed into twisted conductor units with each conductor unit having a single direction of twist along its length and with the angles of twist lays of some at least of the conductor units changing along the length of the core unit and, at any cross-section, being different from twist lay angles of other conductor units.

Preferably, in the above core unit structure, the twist lay angles change continuously and in a practical arrangement, the angles change in a cycling manner between upper and lower limits and preferably with all lay angles either being different or changing in a different sense from another conductor unit which has the same twist lay at any cross-section of the core units.

One embodiment of the invention will now be described, by way of example, with reference to the accompanying drawings, in which:

FIG. 1 is a plan view of main parts of apparatus for forming a stranded core unit of one hundred twisted insulated conductor pairs;

FIG. 2 is a side elevational view of the apparatus of FIG. 1 in the direction of Arrow II in FIG. 1;

FIG. 3 is a plan view of twisting machines and tension equalizing means forming part of the apparatus and shown on a larger scale than in FIG. 1;

Figure 4:
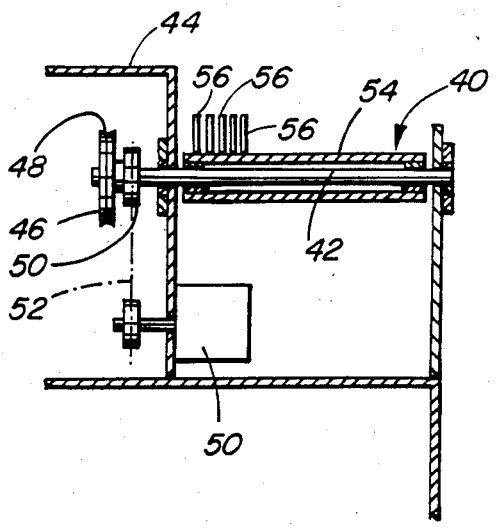
FIG. 4 is a cross-sectional view taken along line IV—IV in FIG. 2 of a tension equalizing means and on a larger scale than in FIG. 2.

As shown in FIGS. 1 and 2, apparatus for making a stranded core unit of one hundred twisted pairs of conductors comprises apparatus for twisting the conductor pairs, including a hundred twisting machines 10 arranged in four straight banks 12 of machines with twenty-five machines in each bank. The apparatus is capable of making cable core unit at speeds of up to and possibly in excess of 600 ft. per minute. Spaced from one end of the four banks 12 there is located a core unit forming and take-up means comprising a stranding machine 14, which is of conventional construction. The forming and take-up means also comprises, in normal fashion, a closing head 16 for drawing twisted conductor units together and a binder 18. The stranding machine comprises a stranding flyer 17 having a "helper" capstan 19 to assist in drawing the conductor pairs through the head 16 and binder 18 in forming the core unit 23. The main drawing means comprises a take-up reel 21 with its drive motor 20. The construction of the forming and take-up means is conventional and will be described no further.

Figure 5:
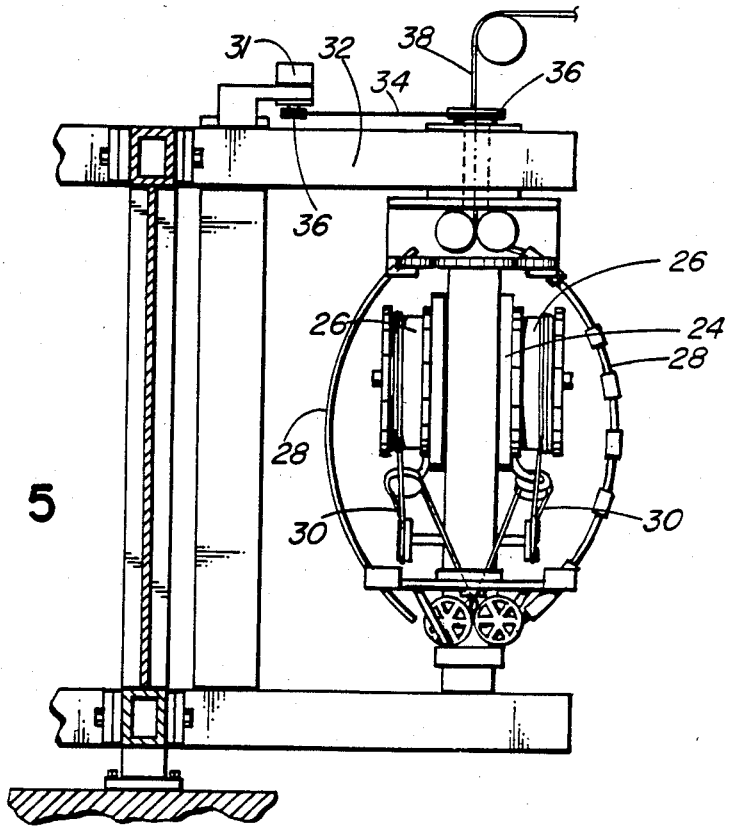
FIG. 5 is a view taken in the direction of arrow V in FIG. 2 of a twisting machine and on a larger scale.

Each of the twisting machines 10 comprises a cabinet 22, (FIG. 3), the cabinets together forming the rectangular shape of the banks 12 in FIGS. 1 and 2. Within each cabinet there is located a reel cradle 24 for holding in rotatable fashion, two reels 26 of individually insulated conductors, as shown by FIG. 5, to enable the conductors to be drawn from the reels under the drawing influence of the stranding machine 14. Each twisting machine may be of conventional construction for enabling the conductors to be drawn from the reels and to be twisted together as they pass through and outwardly from the machine. However, in this embodiment, each twisting machine is of the construction described in a copending patent application entitled "Twisting Machine" Ser. No. 565,635 now abandoned filed concurrently with this present application and in the names of J. Bouffard, A. Dumoulin and O. Axiuk. As described in that specification, each twisting machine comprises two flyers 28 and associated pulleys to provide a balanced rotational structure while avoiding conventional balance weights. The two conductors 30 being removed from the reels 26 pass downwardly together as described in the aforementioned specification and then through a selected one only of the flyers 28. As the conductors move through the flyer, the flyers are rotated to provide the conductors with twist, by a drive motor 31 which is an individual AC motor mounted on top of a frame structure 32 and drivably connected to the flyers by means of a pulley 34 and pulley wheels 36. Each of the AC electric motors is a variable speed drive motor and provides a means for changing the rotational speed of the flyer, according to a feature of this invention as will be described.

As may be seen from FIGS. 1, 2, 3, 4 and 5, each of the twisted pairs 38, as it emerges from the top of its twisting machine, moves along the line of its associated bank 12 of twisting machines and proceeds towards the stranding machine 14.

The apparatus also includes a tension equalizing means and a tension reducing means as described in a copending patent application Ser. No. 565,634 filed concurrently herewith and entitled "Forming Cable Core Units" in the names of J. Bouffard, A. Dumoulin and M. Seguin. The tension equalizing means comprises a plurality of such means 40, one above the downstream end of each twisting machine 10. This is clearly seen from FIGS. 2 and 3, while the equalizing means is omitted from FIGS. 1 and 5 for clarity.

As described in the application entitled "Forming Cable Core Units", each tension equalizing means comprises a shaft 42 extending from side to side of the feedpaths for the twisted pairs, the shaft being rotatable at its ends. One end of the shaft enters an upstanding housing 44 and has a pulley 46 engaged by a drive belt 48. This drive belt drives a group of five of the shafts 42, each of which has a pulley 46. One of the drive shafts for each group of five is driven by a drive motor 50 through a drive member 52. A tubular member 54 is carried in bearings around each shaft 42, so that it is in slipping, drivable engagement with the shaft in that it rotates at substantially the same angular speed as its shaft unless it is restrained. While the bearings carrying the tubular member may suffice for this purpose, the inside of the member may also be packed with grease to hold it in more positive driving engagement with the shaft. Each member 54 extends beneath the feedpaths for the twisted pairs of conductors.

Each drive motor 50 is coupled electrically to a means (not shown) which registers the speed of the core unit through the core unit forming and take-up means. This registering means which is conveniently a rotor pulser is of conventional construction and will be described no further. By the electrical coupling, the speed of the drive motor 50 is such as to provide a peripheral speed for the unrestrained tubular members 54, which is slightly in excess of the draw speed of the twisted pairs into the stranding machine. The peripheral speed of the unrestrained tubular members is a question of choice dependent upon the tension reducing effects that are required. It has been found in practice that the peripheral speed of the tubular members 54 may exceed the speed of the twisted units into the stranding machine by up to five percent and preferably between two and three percent.

As may be seen from the above description, there are twenty-five tension equalizing means along each bank 12 of twisting machines. The furthest equalizing means from the stranding machine supports only one twisted pair 38, i.e. that pair from the furthest twisting machine. The number of twisted pairs supported by equalizing means increases along each bank 12, from equalizing means to equalizing means, until 25 pairs are carried by the equalizing means closest to the stranding machine.

Guide means in the form of guide rods 56 is provided for holding the twisted pairs 38 spaced from one another as they extend across the banks 12 of machines and thus prevents the tension in one pair from influencing that in another. Conveniently these guide rods 56 are located adjacent to but slightly downstream from each of the tubular members 54 and are held stationary in support brackets (not shown) in spaced apart positions axially of the tubular members.

As the 25 twisted pairs of conductors emerge from the downstream end of each of the banks 12, they pass through a tension reducing means for the purpose of reducing the tension in the twisted pairs. As is shown in FIGS. 1 and 2 and more fully described in the copending application entitled "Forming Cable Core Units", the tension reducing means comprises for each bank 12 of twisting machines, two driven rotatable cylinders 58 and 60, around each of which the conductors must pass on the way to the stranding machine. The two cylinders 58 and 60, are of substantially equal diameter and have a common drive (not shown). As described in the application entitled "Forming Cable Core Units", a drive motor for the cylinders is electrically influenced by the line speed of the core unit within the forming and take-up means to provide a peripheral speed of each of the cylinders 58 and 60, slightly in excess of the drawing speed of the twisted pairs of conductors into the stranding machine. The degree of this excess in speed is again subject to choice dependent upon design, but in this particular machine is up to five percent and is preferably in the region of three percent.

It is important to realize that the two cylinders 58 and 60 are not operated to draw the twisted pairs along their feedpaths at the peripheral speed of the cylinders. The cylinders 58 and 60 do not engage each of the twisted pairs along a sufficiently long arc of contact to provide enough frictional grip to draw the pairs from the twisting machines without the assistance of tension upon the pairs downstream of the cylinders and provided by the rotation of the reel 18. This downstream tension provided by motor 16 actually draws the pairs from the twisting machines. In doing so, it pulls the twisted pairs onto the cylinder surfaces to increase frictional contact to enable the cylinders to drive the pairs under friction at a speed substantially that of the draw speed of reel 18. Hence if the stranding machine were omitted, the cylinders 58 and 60 would be incapable of drawing twisted pairs from the twisting machines. While this downstream tension is maintained the cylinders will provide a drive to the twisted pairs with some slippage because of the excess peripheral speed of the cylinders.

During use of the apparatus, there is tension in each of the conductors created by the pull of the motor 20. This tension which differs from one pair to another, is at least partly governed by resistance to rotation of each reel 26 and flyer and the resistance offered by each guiding pulley or other surface with which a pair comes into contact. If these tension differences were still present when the twisted pairs reached the forming and take-up means, they would create differing tension conditions in the core unit which would lead to variations in the electrical characteristics. Also, the finished core unit would be contorted along its length, which would render it difficult or impossible to further process the cable. The tension equalizing means overcomes this problem and the tension reducing means reduces the tensions in the pairs to enable the stranding machine to operate with no overdue strain to draw the total of a hundred twisted pairs for the stranding operation.

As the twisted pairs pass across and are supported by the tubular members 54, they travel at different speeds dependent upon their positions and path lengths in the cable core unit 23 being formed by the forming and take-up means. There is a tendency for the tubular members to urge the twisted pairs in the forward direction because of the faster driven peripheral speed of the members. However, with regard to each tubular member 54, because of the slipping, driving engagement between the tubular members and their shafts 42, the upstream tensions in the twisted pairs and the effect of their relative speeds combine to slow down the speed of rotation of the tubular member to a speed which is influenced by these tensions and relative speeds of the pairs. At this speed of the members, the tensions in the pairs are changed from the upstream to the downstream side of each member with a greater reduction in tension in the more highly tensioned pairs than in the less tensioned ones. There is an influence therefore, towards equalizing the tensions in the pairs moving across each tubular member and this equalizing effect increases as the pairs move towards the final member 54. At each tubular member after the furthest upstream in any bank 12 of twisting machines, a twisted pair of conductors is brought directly from the adjacent twisting machine and over the member by guide pulleys such as pulleys 62 shown in FIG. 3. The tension in this twisted pair, which at this stage may be relatively high, is immediately reduced by the influence of tensions in the other pairs through the intermediary of the tubular member.

At the downstream end of each bank 12, the pairs of conductors with their relative tensions substantially closer than at upstream positions, approach and go through their tension reducing means. As the twisted pairs pass around the cylinders 58 and 60 and proceed through guides (not shown) towards the closing die 16, the pull by the stranding machine increases the frictional contact of the twisted pairs against the surfaces of the cylinders. Although these cylinders are rotating at a peripheral speed which is greater than the throughput speed of the twisted pairs into the stranding machine, their degree of grip upon the pairs is insufficient to draw the pairs from the twisting machines at the peripheral speeds of the cylinders because of the small arc of contact between the cylinders and the twisted pairs as discussed above. Rather, the degree of drive by the cylinders is dependent upon the frictional grip upon them by the pairs which increases and decreases in proportion to the downstream tension created by the draw of the stranding machine. Hence, the drive by the cylinders upon each pair is purely frictional and serves to reduce tension in the twisted pairs. Any slight increase in the tension downstream from the cylinders will improve their frictional engagement with the pair, thereby reducing the tension again. It follows that the tension in any twisted pair upstream of the cylinders (e.g. up to 3 lbs.) is reduced on the downstream side to an acceptable level (e.g. about 1.0 lbs.) for drawing into the stranding machine. It is stressed that the driving force applied to each twisted pair is dependent upon the downstream tension in that pair. Hence, the cylinders 58 and 60 drive each twisted pair at any moment at its own individual speed irrespective of the speed of any of the other pairs. The speeds on the pairs must, of course, differ from one another because of the different path lengths they will occupy in the core unit. The operation of cylinders 58 and 60 thus conveniently allows for this.

It is a particularly important aspect of the present invention that each of the drive motors 31 is independently drivable at a speed such as to provide a particular twist lay to the pair of conductors being formed by the associated machine 10. This twist lay may be completely independent of twist lays of other pairs and may be changed either during the twisting of the pairs and forming of a core unit or after formation of one core unit and before start-up of a subsequent pair twisting and core unit forming operation.

Figure 6:
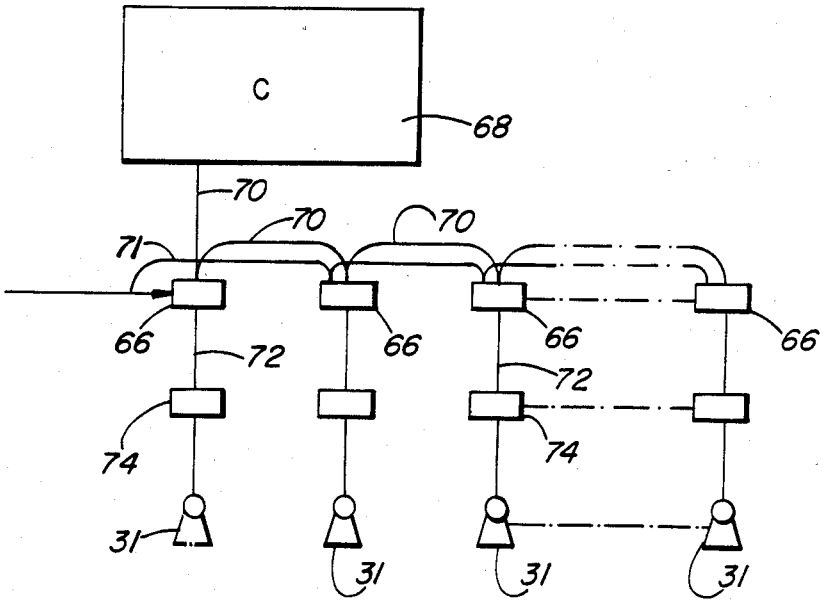
FIG. 6 is a control circuit for rotating flyers of twisting machines at different speed ratios.

FIG. 6 shows a control means for controlling the rotational speeds of the flyers. This control means comprises a hundred microprocessors 66, i.e. one microprocessor for each motor 31. A computer 68 is connected by an address bus 70 to each of the microprocessors. The conventional means provided for measuring the actual line speed of a core unit as it is being drawn into the stranding machine is connected to each of the microprocessors by lines 71 to send frequency signals on a continuous basis, these signals corresponding to the actual core unit line speed.

The computer contains instructions for issuing to each of the microprocessors for controlling its associated AC motor 31 to drive the flyers of its twisting machine at the appropriate speed and provide the required twist lay to the pair of conductors being twisted upon that machine. These instructions correspond to a particular or actual line speed of the core unit being made. The computer addresses the microprocessors on the address bus 70 and sends the instructions to each microprocessor in the form of a digital signal which corresponds to the required twist lay produced by that particular twisting machine. This signal is stored in a memory means of the microprocessor until it is replaced by a new digital signal sent on the address bus. A signal is then sent by each microprocessor along line 72 to an AC inverter drive 74. This signal is an AC signal having a frequency corresponding to the digital signal sent on the address bus, but influenced by the frequency signal for the line speed received on line 71 so that it is modified to control the appropriate motor 31 to produce the twist lay required for the actual line speed of the core unit. Upon receiving the signal, the AC inverter drive 74 converts the incoming signal to DC current and scrambles it to reconvert it into an AC output signal of the required frequency to drive the AC motor 31 at the desired speed. The inverter drive has the effect of reducing the frequency from that received by it from the microprocessor and this frequency is one which is suitable for sending to the motor 31.

Hence, with this control means a signal may be sent from the computer to each microprocessor for start-up of a core unit forming operation, and then the angles of twist lays produced by each of the twisting machines is as desired and controlled by the rotational speeds of each AC drive motor 31. Thus, at the end of manufacture for each core unit, fresh instructions may be fed into the computer to send signals to the microprocessors upon a subsequent operation to form a core unit with twisted pairs having different twist lay angles from the core unit which was formed previously. Hence the control means enables the apparatus together with the individual AC drive motors, to avoid the conventional necessity of having a storage and inventory of reeled twisted pairs of conductors of different gauges, colours and lay angles. As will be appreciated with the apparatus of the present invention, core units of different design, different lay angles, different conductor gauges, different colour and different types of insulation may be produced merely by changing the reels 26 for fresh reels in the twisting machines and by providing different instructions to the computer 68 for controlling the microprocessors.

While it is therefore envisaged that the apparatus will produce core units with different twist lay angles for the conductor pairs, it is also within the scope of this apparatus to produce core units in which the lay angles vary in one or more pairs as they extend along the core unit. Variation in twist lay angles will tend to reduce or eliminate any influence that the twist lay angles of various pairs can have upon one another in an electrical or magnetic sense, which could have deleterious effects upon the communications performance of the cable core. In use of the apparatus described and according to a preferred aspect of this invention, one or all of the twisted pairs may have twist lay angles which vary and these angles preferably vary on a continuous cyclical basis between upper and lower twist angle limits. While it is possible to have twisted pairs in a core unit which are spaced widely and have substantially the same twist lay angle, this apparatus makes it possible to provide varying twist lay angles which at any particular position along the core unit either differ one from each of the others or two of the angles may be the same as one another over an insignificantly short distance at cyclic crossover points with the angles changing in opposite sense from one another. This can be effectively provided by issuing suitable instructions through the computer 68 to cause the flyers 28 to rotate at varying speeds to produce twist lay angles, which while lying between the same upper and lower limits, do in fact, cycle between these limits in out-of-phase relationship with each other.

As an example for the manufacture of the one hundred pair core unit 23 described above, twelve out-of-phase cycling twist lay angles are provided. Eight of the phases may each be applied to eight pairs of conductors and the remaining four phases may each be applied to nine pairs of conductors.

Figure 7:
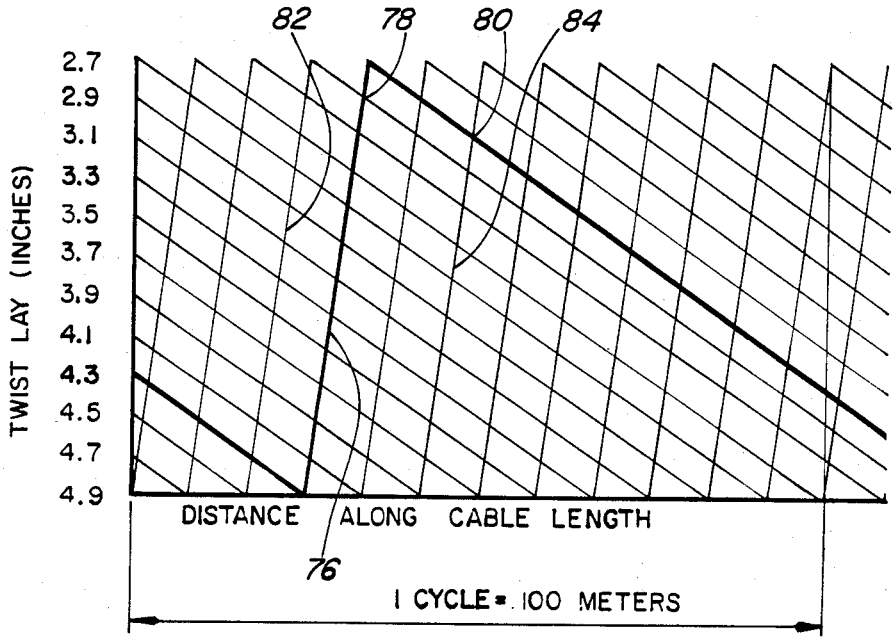
FIG. 7 is a chart showing the values of changing twist lays in a core unit.

In the graph of FIG. 7, the twelve cycling twist lay angles are represented on the vertical scale by the corresponding twist lays which would be produced by the angles at points on the cycle if each of those angles was used without change. For instance, each cycle has the twist lay angles cycling between an angle which is represented by upper limit of twist lay of 4.9 inches and one which is represented by a lower limit of 2.7 inches. A complete cycle for each twisted pair occurs over a distance of approximately 100 meters of the finished core unit. Thus, the cycles of twist lay angle of the pairs have substantially equal lengths, amplitudes and other cyclic characteristics to produce average twist lays in the units which are substantially equal thereby minimizing differences in the mutual capacitance from one pair to another and which is influenced by the twist lay. In the stranded core unit, care should be taken to place all conductor pairs having the same cycle of twist lay angle spaced from one another to ensure good crosstalk performance between pairs and pair-to-pair capacitance unbalance. Undoubtedly, as shown by the chart of FIG. 7, at certain insignificantly short distances along the core unit length, each cycling phase of twist lay angles produces an angle equal to that of another phase where one twist lay angle is increasing on its cycle, while the other is decreasing. For instance, with regard to the cycle 76, this cycle has the same twist lay and lay angle value at points 78 and 80 as cycles 82 and 84 respectively for different conductor pairs. If the twist lay angles of the pairs are equal at these crossover points on the chart, then these points represent extremely short distances along the core unit which can have only an extremely minor effect upon the electrical characteristics of the finished cable. To ensure that these points of crossover are as short as possible, then the method of producing the varying lay angles ensures that the motors 31 drive in such a way as to produce movement along the cycle between the cycle limits in one direction along a shorter length of core unit than in the other direction.

For instance as shown by FIG. 7, the movement from 4.9 to 2.7 inches of each corresponding twist lay (and thus the lay angle change) occurs over an extremely short length of core unit compared to movement along the cycle in the opposite direction. This rapid increase ensures that each crossover point, e.g. 78 or 80, is as short as possible.

Figure 8:
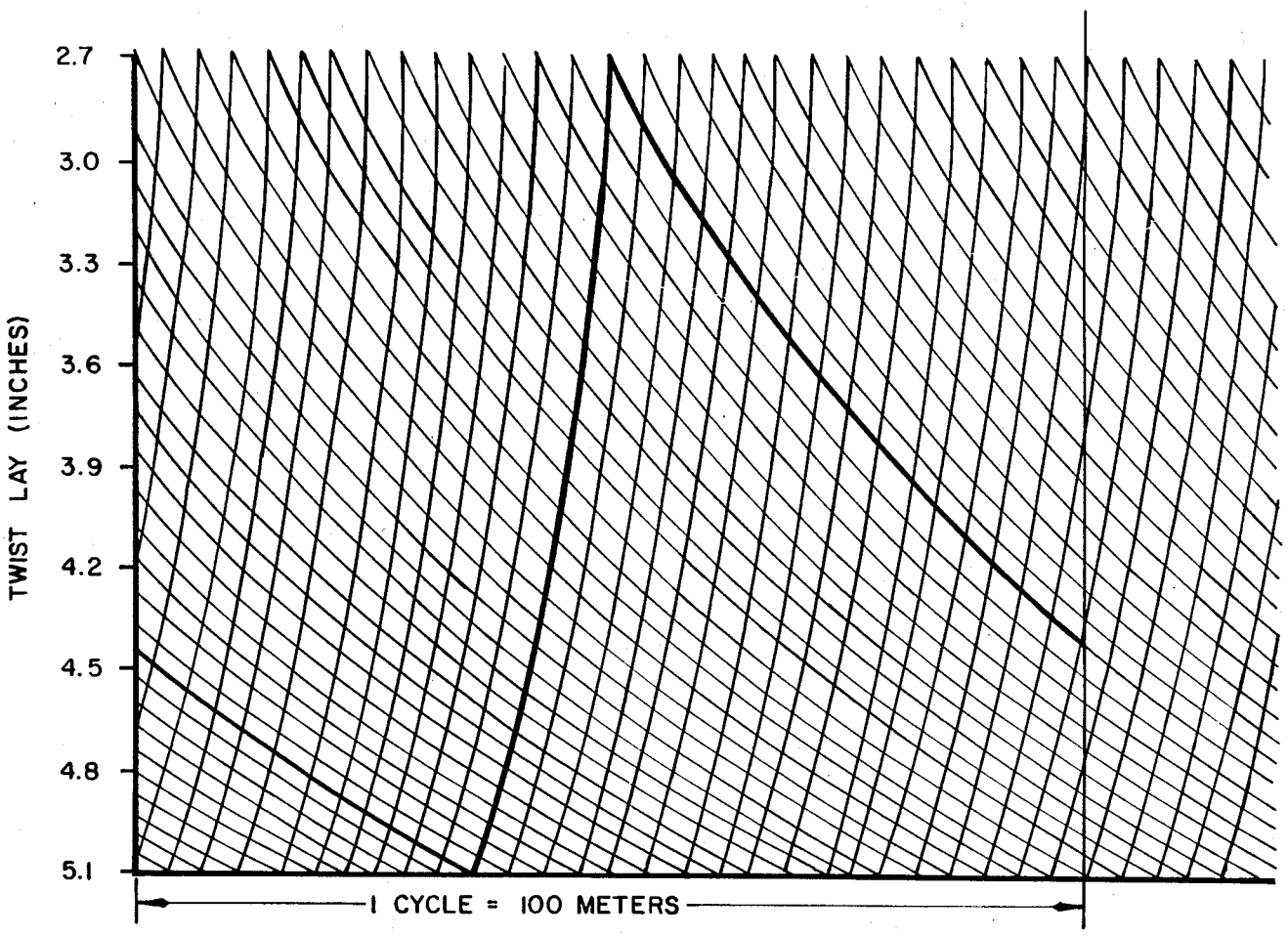
FIG. 8 is a chart similar to FIG. 7 of another core unit.

FIG. 8 is a graph representing a possible twenty-five out-of-phase cycles of lay angles. As shown in FIG. 8, the varying twist lay angles are represented by upper and lower limits of twist lay of 2.7 and 5.1 inches and each cycle occurs over approximately 100 meters.

As described, FIGS. 7 and 8 show cycles of twist lay angles with substantially equal lengths and amplitudes. However, substantially equal average twist lays in the conductor pairs may be produced by having varying cycle lengths and amplitudes in the cycles of twist lay angle in each pair, but, of course, this would be more difficult to accomplish.

Hence, in a cable incorporating the core unit made according to the method described above and also according to the invention, the average twist lay of each conductor unit is substantially equal to that of every other unit thereby substantially entirely avoiding differences in mutual capacitance and mutual inductance between the conductor units which is influenced by the twist lay.

What is claimed is:

1. Apparatus for making a core unit for a telecommunications cable from twisted unit of individually insulated conductors comprising:

a plurality of twisting machines disposed in an in-parallel relationship to one another relative to a general passline through the apparatus, each machine for carrying a plurality of reels of insulated conductor and each machine comprising a flyer which is rotatable to introduce twist into conductors to cause them to twist to form a twisted unit;

rotating means for rotating each of the flyers at speeds which are variable independently of other flyers and for changing the ratio of the rotational speed of the flyers, each rotating means comprising a variable speed drive motor;

control means to control the speed of each variable speed drive motor for rotating the flyer of the associated twisting machine at a speed appropriate to the line speed of the apparatus to produce the desired angle of twist lay, the control means including a computer, a microprocessor for each drive motor, the computer connected to each microprocessor to send a first signal thereto which corresponds to the desired angle of twist lay of a twisted unit to be formed by the associated twisting machine at a given line speed of the apparatus, each microprocessor having a memory for storage of the first signal, a measuring device for measuring the actual line speed and for sending a second signal corresponding to actual line speed to each microprocessor, each microprocessor capable of emitting a basic control signal corresponding to the stored first signal as modified by the second signal to control the speed of its associated drive motor to provide the desired angle of twist lay at the actual line speed; and a core unit forming and take-up means in tandem with and downstream from the twisting machines to draw the twisted units together and form a core unit, the forming and take-up means comprising drawing means to draw twisted units into the forming and take-up means.

2. Apparatus according to claim 1, wherein each variable speed drive motor is an AC motor and an AC inverter drive is disposed between each microprocessor and its associated AC motor, the basic control signal is an AC frequency control signal, and the inverter drive is capable of converting the basic control signal to a final control signal, which is an AC frequency control signal and which is received by the AC drive motor to control its drive speed.

3. Apparatus according to claim 1, wherein each variable drive speed motor is an AC motor and the first signal sent to at least one microprocessor is changeable during operation of its AC motor to rotate the flyer and during stranding of a core unit.

4. Apparatus according to claim 1, wherein the first signal sent to each microprocessor is changeable.

5. Apparatus according to claim 1, wherein each variable drive speed motor is an AC motor and the first signal sent to each microprocessor is changeable and, at any particular time, is such as to result in the AC motor associated with the micrprocessor being driven at a speed to rotate its flyer at a different rotational speed from all other flyers.

6. Apparatus according to claim 5, wherein each first signal is changeable in a cyclic manner to cause rotation of its flyer to produce the angle of twist lay of the associated twisted unit to increase and decrease continuously between upper and lower limits.

7. Apparatus according to claim 6, wherein the value of the first signal changes in one direction during its cycle at a different rate from that of the other direction.

8. Apparatus according to claim 5, wherein the first signals set to the microprocessors are changeable in cycles which are of the same length and are all out-of-phase with one another.

* * * * *